United States Patent [19]

Budich et al.

[11] 4,286,716

[45] Sep. 1, 1981

[54] BUILDING KIT FOR VERTICAL OR HORIZONTAL SLIDING WINDOWS

[75] Inventors: Wolfgang Budich; Hans Theissen, both of Troisdorf-Eschmar, Fed. Rep. of Germany

[73] Assignee: Dynamit Nobel Aktiengesellschaft, Troisdorf, Fed. Rep. of Germany

[21] Appl. No.: 81,148

[22] Filed: Oct. 2, 1979

[30] Foreign Application Priority Data

Oct. 2, 1978 [DE] Fed. Rep. of Germany ..... 2842884

[51] Int. Cl.[3] ..... B65D 71/00

[52] U.S. Cl. ..... 206/577; 49/425; 49/504; 49/404

[58] Field of Search ..... 49/504, 404, 501, 453-456, 49/425; 206/577; 52/207

[56] References Cited

U.S. PATENT DOCUMENTS

| | | | |
|---|---|---|---|
| 3,520,084 | 7/1970 | Gigante | 49/504 X |
| 3,555,736 | 1/1971 | Koch, Jr. et al. | 49/504 |
| 3,667,179 | 6/1972 | Eisenberg | 49/504 X |
| 3,780,473 | 12/1973 | Kort et al. | 49/504 X |
| 3,859,754 | 1/1975 | Budich et al. | 49/501 X |
| 3,946,524 | 3/1976 | Budich | 49/425 X |
| 3,959,926 | 6/1976 | Noecker et al. | 49/504 X |
| 3,978,617 | 9/1976 | Eventoff | 49/404 |
| 4,151,682 | 5/1979 | Schmidt | 49/504 X |

*Primary Examiner*—Philip C. Kannan

*Attorney, Agent, or Firm*—Craig and Antonelli

[57] ABSTRACT

A building kit for vertically or horizontally slidable windows which includes a multiple-chambered blind frame profile member fashioned of a synthetic resinous material which is identical for all four sides of the windows and sash profiles of hollow synthetic resinous material which are identical for all four sides of the window as well as an optional horizontal running track. The blind frame profile is fashioned so as to be planar on a side facing the sash except for approximately a centrally arranged projecting guide tongue strip extending in the longitudinal direction of the blind frame profile. An open undercut guide groove is provided in the blind frame profile member followed on each side of the chamber. To seal the sash along the corresponding inside of the window the blind frame is connected with a U-shaped end profile of a synthetic resinous material which is at most half of the width of the blind frame. The end profile is guided selectively either on the guide tongue strip or in the opening of the guide groove.

32 Claims, 18 Drawing Figures

BUILDING KIT FOR VERTICAL OR HORIZONTAL SLIDING WINDOWS

The present invention relates to a building kit and, more particularly, to a building kit for vertically or horizontally displaceable windows which include a blind frame formed of a multiple-chambered profile member of a synthetic resinous material, identical on all four sides, and sashes formed of a hollow profile member of a synthetic resinous material, identical on all four sides, and, if desired, a horizontal running track for guiding the displaceable window.

In, for example, U.S. Pat. Nos. 3,946,524 and 3,859,754 as well as in German Utility Model No. 7,520,142, numerous constructions for sliding windows or sliding doors for vertical and/or horizontal displacement have been proposed.

The aim underlying the present invention essentially resides in providing a sliding window of profile members of a synthetic resinous material by which it is possible, with a uniform system of profile members, to construct a horizontal as well as a vertical sliding window of small as well as large dimensions with the assembled window being adapted to enable an installation of commercial fittings for window latches.

In accordance with the present invention, a building kit of the aforementioned type is proposed wherein a blind frame profile member is fashioned so as to be planar on a side facing the sash with the exception of an approximately centrally disposed projecting guide tongue or cam strip which extends in a longitudinal direction of the blind profile member. The blind profile member also includes an open undercut guide groove on each side of which a chamber is provided. For sealing the sash along the corresponding insides, the blind frame profile member is adapted to be connected with a U-shaped end profile member of synthetic resinous material having, at most, half the width of the blind frame member. The end profile member is selectively guided on the guide tongue strip or in an opening of the guide groove.

By virtue of the above-noted constructional features of the blind frame profile member of the present invention wherein the planar surface is interrupted only by a single projecting guide tongue strip and/or having one opening in the form of a guide groove, it is possible to supplement the blind frame profile member with a greater versatility by means of connecting profiles added to the sliding sashes and/or by means of insertion and accommodation of commercial fittings.

As can readily be appreciated, the blind profile members of the present invention may be mitered so as to enable a joining of the corners of the window frame with the corners then being either welded together or screwed together by means of additional corner angles. Moreover, by constructing the blind frame profile member as a multiple-chambered hollow profile member sufficient rigidity is obtained even for large-sized frames.

In accordance with further features of the present invention, an end profile member is constructed as a substantially U-shaped member with an outwardly projecting shoulder being provided approximately in the center of a web connecting the legs of the U-shaped member. The shoulder has a width corresponding to an opening width of the guide groove of the blind frame profile member. Moreover, the end profile member is provided with a guide groove in parallel to the blind frame profile member in the corner zone of one of the legs of the U-shaped member, which guide groove serves for receiving the guide tongue strip of the blind frame profile member.

In correspondence with the guide tongue strip and/or opening of the guide groove of the blind frame member, used as aids in the assembly of the window, the U-shaped end profile member is fashioned with analogous supplementary projections and grooves, respectively, so that the U-shaped profile member may be selectively inserted in the opening of the guide groove of the blind frame profile member or may be clipped onto the guide tongue strip of the blind frame profile member and thus can be dimensionally unequivocally fixed in position on the blind frame profile member.

Since the sliding windows must likewise be equipped with seals or gaskets in a zone of the sliding surfaces thereof, in accordance with further features of the present invention, the leg of the U-shaped end profile member has, on an inside thereof, a groove for receiving a seal or gasket. Further seals or gaskets may also be suitably mounted by means of corresponding grooves on the sash profile members.

Preferably, the glass panes, single-glazed or double-glazed windows, i.e. Thermopane windows, are mounted in position by inserting the glass panes into a silicone seal. For this purpose, in accordance with the present invention, the sash profile member is fashioned with an open channel with lateral channel walls having concave recesses terminating in projecting tongues or cams. By virtue of such a construction of a sash profile member and the glazingaccommodating channel, a secure anchorage of the glass panes and/ or the silicone sealing compound is ensured.

According to further features of the present invention, the sash profile member is fashioned in such a way that, on a side opposite the glaze-accommodating channel, two juxtaposed undercut grooves of varying size are arranged for the selective mounting by, for example, clipping in, of sealing profiles or cover profiles for fittings such that the versatility of the sash profile member is thereby increased.

For economical reasons, since also in the construction of the profile members of synthetic resinous material for the blind frame member and sash member, a minimum amount of material is to be utilized and the mechanical rigidity of the profile members is likewise limited in correspondence with the material employed. However, for the spot-wise mounting of fittings to the sash profile member as well as to the blind frame profile member, an increased strenght of the profile member is desireable to avoid bending or deformation. In this connection, the present invention proposes the fashioning of the profile member for the blind frame member and the sash member with reinforcing lobes on the inside of a chamber for the attachment of fittings. The reinforcing lobes, in the shape of tongue strips, extend in the longitudinal direction of the profile member and may be provided in pairs depending upon the size of the chamber and on the fitting to be accommodated.

In accordance with further features of the present invention, for vertical sliding windows, the horizontal sides of the blind frame profile member are respectively connected with one U-shaped end profile member and the vertical sides for the upper sliding sash, which sides face the sash profile member, with respectively one U-shaped guide profile member, the legs of which respectively include one chamber. Thus, while a simple U-shaped profile member serves as the connecting profile member for connecting the sash profile member for the horizontal blind frame sides, a more compact guide profile is suggested as connecting means for the vertical side for the outer or upper sash. Additionally, the more compact profile member then assumes the task of providing a sealing closure as well as accommodation of a mechanism of a fly screen blind and also the possibility of accommodating fittings for the sliding window.

In accordance with the present invention, the U-shaped guide profile member form a guide groove between the legs of the U-shaped member, with the guide groove being undercut an opening width. The guide groove has which is as large as an opening width of the guide groove of the blind frame profile member. Moreover, one leg of the U-shaped guide profile may terminate in an open groove for receiving guide means of a fly screen roller blind. Additionally, the U-shaped guide profile member may be suitably provided, on its side facing the blind frame profile member, with a guide groove corresponding to a guide tongue strip of the blind frame profile member, whereby the assembly is facilitated. The guide profile member and the end profile member may be attached to the blind frame either by gluing or by fasteners such as, for example, screws or the like.

With a vertical sliding window, to obtain the same inside dimensions for the entrance of light, i.e., the same glass pane size, for the upper sash as well as the lower sash, in accordance with further features of the present invention, the upper sash is formed of a sash profile member which has a chamber of a smaller height than a chamber of the sash profile member for the lower sash. In this way, the differing reductions in the inside diameter of the blind frame, effected by the additional profile members, such as the guide profile member and the end profile member, are compensated for.

To construct horizontal sliding windows with a building kit of the present invention, the blind frame member may be connected on the inside along its upper horizontal side with two juxtaposed end profile members, along its respective vertical sides with one end profile member, and along its lower horizontal side with a metallic running track member.

The track member required for the horizontal sliding windows is fashioned, in accordance with the present invention, in such a manner that the track member has, on a side facing the blind frame member, a shoulder projecting in the form of a U-shape and has a width corresponding to an opening width of the guide groove of the blind frame profile member.

Advantageously, with the building kit system of the present invention, all the profile members are fashioned to be uniform thereby making it possible to construct, with a relatively low number of structural components, horizontal sliding windows as well as vertical sliding windows of small as well as large dimensions.

As a supplement to the building kit system of the present invention, the sliding windows may be equipped with commercially available fittings for latching purposes, which fittings are adapted to be mounted to the corresponding profile members and additionally covered by means of additional profile members normally made of, for example, aluminum.

Accordingly, it is an object of the present invention to provide a building kit for horizontal or vertical sliding windows which avoids, by simple means, shortcomings and disadvantages encountered in the prior art.

Another object of the present invention resides in providing a building kit for horizontal or vertical sliding windows which may be construced by a uniform system of profile members.

Yet another object of the present invention resides in providing a building kit for vertical or horizontal sliding windows which readily accommodates commercial fittings for the windows.

These and other objects, features, and advantages of the present invention will become more apparent from the following description when taken in connection with the accompanying drawings which show, for the purposes of illustration only, several embodiments in accordance with the present invention, and wherein.

Figure 1:
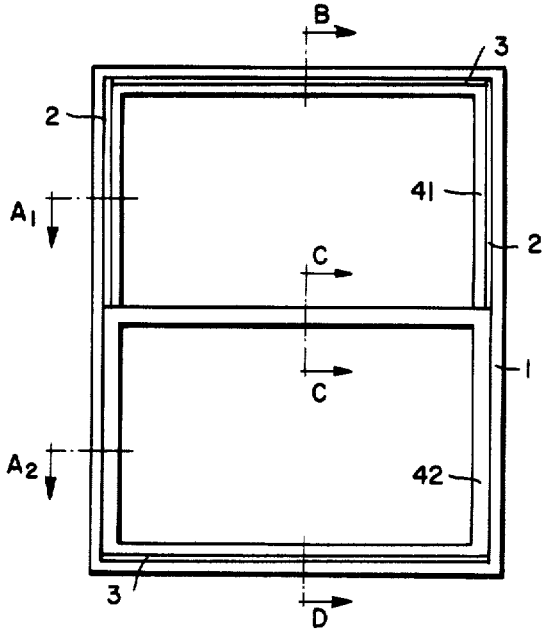
FIG. 1 is an internal view of a vertical window constructed from a building kit in accordance with the present invention.

Referring now to the drawings wherein like reference numerals are used throughout the various views to designate like parts and, more particularly, to FIG. 1, according to the this Figure, a vertical sliding window, as viewed from an inside thereof, includes a blind frame composed of the blind frame profile members with an upper sash being composed of sash profile members 41 and the lower sash being composed of sash profile members 42 which are adapted to be displacably guided. In a transition to the upper sash, the guide profile members 2 are provided along the vertical sides of the blind frame; whereas, U-shaped end profile members 3 are attached to the horizontal sides of the blind frame for connection to the upper and lower sashes. The structure of the individual profile members are more clearly illustrated in FIGS. 6–10 each of which will be discussed more fully hereinbelow.

Figure 6:
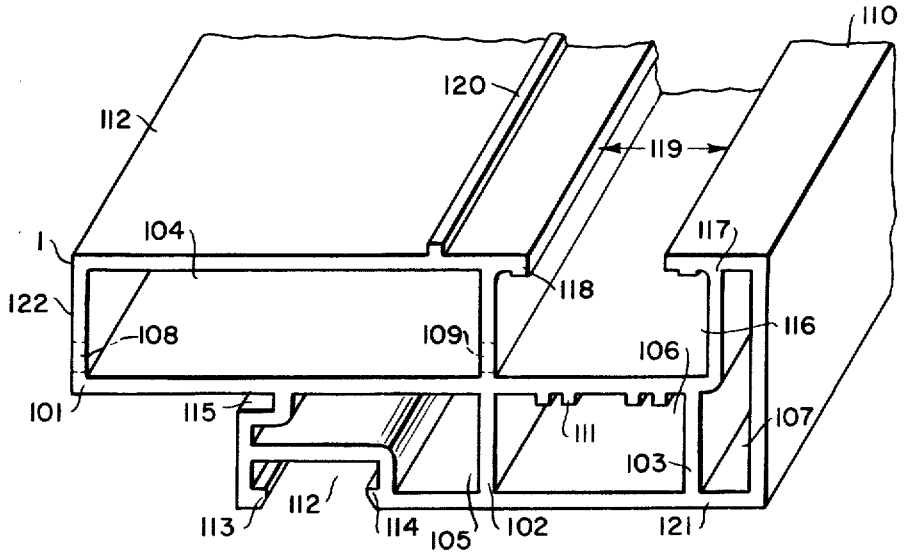
FIG. 6 is an elevational view of a blind profile member in accordance with the present invention.

As shown in FIG. 6, the blind frame profile member 1, produced, for example, from a thermoplastic synthetic resinous material, such as, for example, a hard PVC, by extrusion, is formed as a multiple chambered hollow profile member. A characteristic of the blind profile member 1 is that, facing the sash, a wall 112 of the blind frame profile member is completely planar and is interrupted only by an approximately centrally disposed projecting guide tongue 120 and an undercut guide groove 116. The blind frame profile member 1 is once more subdivided between a wall 121 at the rear of the profile member 1 and the inner surface of the wall 112 of the profile member 1 by means of a central web or bridge 101 which extends parallel to the inner surface of the wall 112 by way of vertically extending webs 102, 103. The blind frame profile member 1 is partitioned in its entirety into chambers 104, 105, 106 and 107 arranged between the walls 112, 121 with the chambers 104, 106 and 107 being disposed so as to surround the guide groove 116. The guide groove 116 is dimensioned so that fittings can be accommodated therein and an opening width 119 of the guide groove 116 is an important dimension for enabling the connection of the further profile members. Moreover, the construction of the blind frame profile member 1 with several chambers 103, 104, 105, 106 serves, in particular, also for reinforcing and enhancing the mechanical load bearing ability of the blind frame profile member 1. Openings 108, 109 may be provided in the vertical web 102 and end wall 122 so that the chamber 104 can then serve as a drainage chamber.

A projection 110, seals off the guide groove 116 in the manner of a chamber toward the outside with the projection 110 extending by way of a projecting lug 117 into the opening of the guide groove 116. Likewise, a projecting hook-shaped lug 118 is formed on the opposite side of the opening of the guide groove 116.

Additional grooves are provided on a side of the blind frame profile member 1 facing the masonry for the accommodation of fittings and/or additional connecting profiles such as, for example, an insert groove 115 and/or an undercut groove 112 defined by the projections 113, 114. The chamber 106 adjoining the guide groove 116 is fashioned along its boundary wall with the strip-shaped projections, tongues, or lobes 111 forming a reinforcement for the intermediate wall 101 thereby enabling the attachment of fittings as shown most clearly in, for example, FIG. 2.

Figure 7:
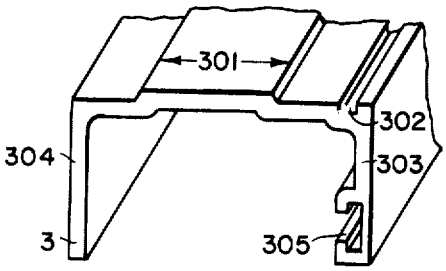
FIG. 7 is a elevational view of an end profile member in accordance with the present invention.

As shown in the partial elevational view of FIG. 7, the U-shaped end profile members 3, for example, extrude from hard PVC is of a relatively simple structure and includes two legs 303, 304 with only the leg 303 being formed, on an inside thereof, with an undercut groove 305 for accommodating a sealing means. A web connecting the two legs 303, 304 forms the contacting surface and mounting surface for the blind frame profile member 1 and, for this purpose, the web is provided with a projecting shoulder 301 having a width which corresponds to an opening width 119 of the guide groove 116 of the blind frame profile member 1. A guide groove 302 is provided in a corner zone of the web from which the leg 303 extends. The guide groove 302 extends in the longitudinal direction and serves to accommodate the guide tongue strip 120 of the blind frame profile member 1. Consequently, it is possible to fix the end profile member 3 in position in a zone of the projecting shoulder 301 as well as in a zone of the guide groove 302 of the blind frame profile member 1 with the final mounting then being accomplished either by, for example, gluing or fasteners such as, for example, screws of the like.

Figure 8:
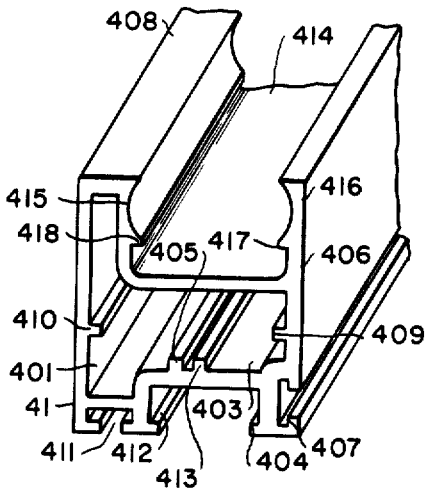
FIG. 8 is an elevational view of a first sash profile member in accordance with the present invention.
Figure 9:
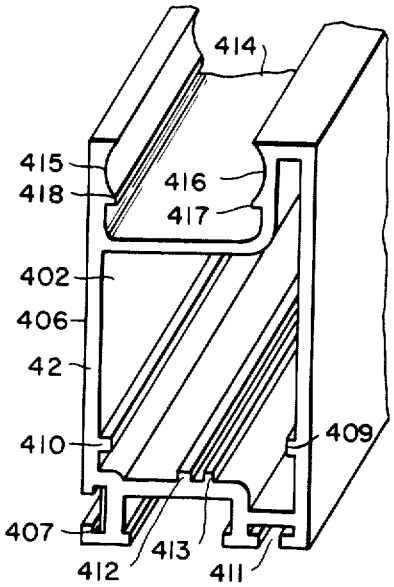
FIG. 9 is an elevational view of a second type of sash profile member in accordance with the present invention.

FIGS. 8 and 9 provide examples of sash profile members 4 of varying sizes but with, in principle, identical configuration. In FIG. 8, a smaller sash profile member 41 is provided with an inner chamber 401; whereas, in FIG. 9, a larger sash profile member 42 is provided with an inner chamber 402. The profile members 41, 42 differ from each other merely in the difference in heights of the respective chambers 401, 402. Each of the sash profile members 41, 42 are provided with a glazing channel 414 for mounting glass panes with the walls of the channel 414 having concave recesses 415, 416 terminating toward the inside of the channel 414 in projecting lobes 417, 418.

While one side wall 406 of the sash profile members 41 or 42 is constructed merely as a projecting tongue with an undercut groove 407 at the end of the blind frame to accommodate a sealing means, diagonally opposite the undercut groove 404, a web 408 projects in the manner of a chamber so as to define a contact surface. The side of sash profile member 41 or 42 which is adapted to face the blind frame profile member 1 is fashioned on one side with a small undercut groove 411 adapted to receive a sealing means and, adjacent to the undercut groove 411, with a larger likewise undercut groove 403 defined by the projections 405, 404 with the undercut groove 403 serving for accommodating fittings.

The wall of groove 403 is provided on an inside thereof with reinforcing lobe strips 412, 413 to increase the rigidity of the profile members 41 or 42. Since the sash profile member 41 or 42 are preferably assembled into the sashes by means of corner angles which may be mounted by gluing or by fasteners such as, for example, screws, projecting lobes 409, 410 are additionally provided in the chamber 401 for mounting of the corner angles. As with the blind frame profile members 1, the sash profile members 41 and 42 are likewise extruded from a synthetic resinous material such as a hard PVC.

As apparent from the above description, the larger sash profile member 42 of FIG. 9 and the smaller sash profile member 41 both have the same functionally required structure.

Figure 10:
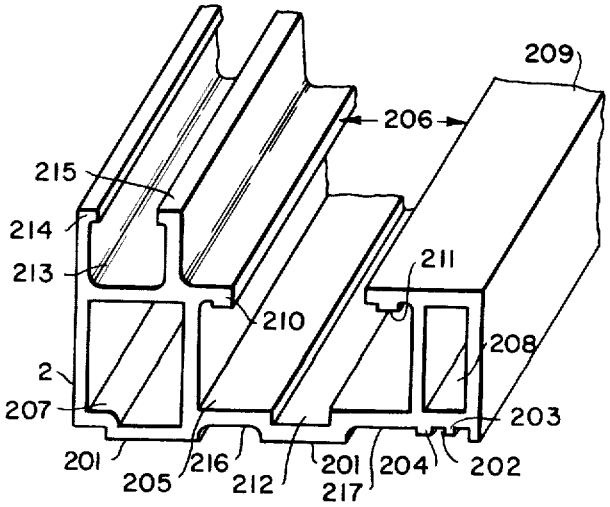
FIG. 10 is an elevational view of a guide profile member in accordance with the present invention.

FIG. 10 provides a partial elevational view of the vertical profile member 2 which serves for the lateral guidance of the upper sash. The guide profile member 2 has a substantially U-shaped configuration and includes, analogously to the blind frame profile member 1, an undercut open guide groove 205 for receiving fittings with a width 206 of the guide groove 205 corresponding to an opening width of the guide groove 119 of the blind frame profile member 1. The guide groove 205 is defined on a side by a chamber-like projection 208 forming a planar contact surface 209 and bounding the opening of the guide groove 205 with an undercut projection 211. On the other side of the groove 205, a chamber-like projection 207 is formed with an upwardly open groove 213 being attached thereon. The open groove 213 is defined by two lateral webs with projections 214, 215.

On a side 201 of the guide profile member 2 adapted to face the blind frame, indentations 216, 217 are provided forming a recess 212 on the inside of the groove 205. The recess 212 enables an insertion of mounting screws for the fittings. Surfaces 201 of the guide profile member 2 serve, for example, for gluing the guide profile member 2 to the blind profile member 1. The guide profile member 2 is preferably extruded from a synthetic resinous material such as, for example, a hard PVC. To facilitate mounting, the guide profile member 2 is unilaterally provided with a guide groove 202 formed between the two projections 203, 204. The two projections 203, 204 are recessed with respect to the surface 201. The guide groove 202 serves for locking onto the guide tongue strip 120 of the blind frame profile member 1.

Figure 11:
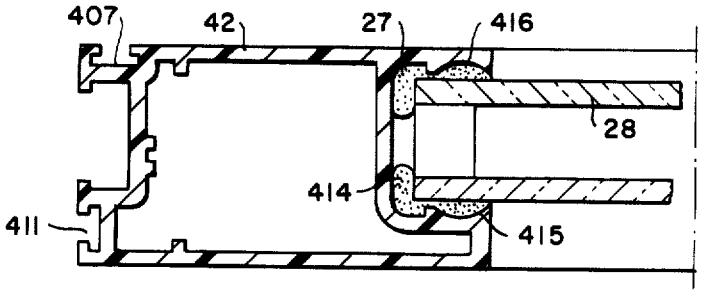
FIG. 11 is a cross-sectional view of a sash profile member in accordance with the present invention having a glazing mounted thereon.

As shown in FIG. 11, the insulating glazing 28 is mounted in the sash profile member 42 by way of a silicone compound 27 which is introduced into the glazing channel 414 along the indentations or recesses 415, 416 and distributed by pressing the glazing 28 into place whereby the glazing 28 is sealingly affixed by pressure.

Figure 2:
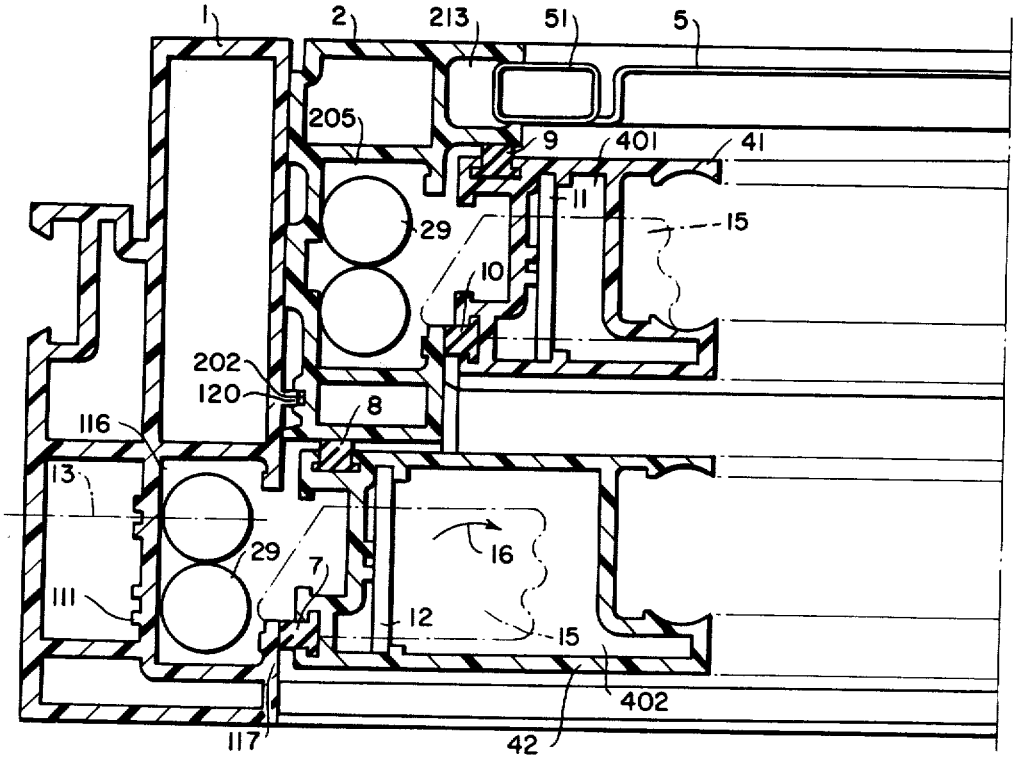
FIG. 2 is a cross-sectional view taken along the lines $A_1$ and $A_2$ in FIG. 1.

FIG. 2 provides a horizontal section through the vertical sliding window of FIG. 1 taken through the vertical blind frame side and shows, in side by side relation, a cross-section through the upper sash member 41 ($A_1$) and the lower sash member 42 ($A_2$). The guide profile member 2 is mounted on the inside to the blind frame profile member 1 for the upper sash by, for example, gluing, wherein the guide tongue strip 120 is fitted into the corresponding guide groove 202. A lateral guide strip 51 of a fly screen roller blind 5 is guided into the groove 213 of the guide profile member 2. The upper sash profile member 41 is guided in a zone in front of a groove opening 206 and contacts, with inserted sealing means 9, 10 corresponding surfaces of the guide profile member 2.

A fitting 29 is arranged in the guide groove 205 of the guide profile member 2 and fixedly secured by, for example, screws or the like in a manner not shown in detail, to the guide profile member 2 and to the blind frame profile member 1. Furthermore, a tongue 15 of a latch fitting engages into the groove opening 206 which fitting is additionally illustrated in FIGS. 3 and 4. The sash profile members 41, 42 are joined together at the corners by inserted corner connectors 11, 12 inserted between the inner chambers 401, 402 of the sash profile members 41, 42 between the corresponding projecting tongues 409, 410 (FIGS. 8, 9).

The lower sash profile member 42 is seated directly on the groove 116 of the blind frame profile member 1 and, as shown most clearly in FIG. 2, the widths of the groove 205 of the guide profile member 2 and of the guide groove 116 of the blind frame profile member 1 correspond to each other in their dimensions. A fitting 29 is also accommodated in the groove 116 on the blind frame profile member 1 which fitting is mounted by means of suitable fasteners such as, for example, screws 13 of the like, to the intermediate webs of the blind frame profile member 1, which webs are reinforced in this zone by the projecting tongue strips 111. Also, the sash profile member 42 is sealed by means of an inserted sealing means 7, 8, respectively guided on the blind frame profile member 1 and on the guide profile member 2.

As can also be seen from the cross-sectional view of FIG. 2, the guide profile 2 serves for the multiple functions of accommodating fittings, of affecting a seal also with respect to the second sash, and of providing guidance for the fly screen roller blind. It can also be seen from the sectional view of FIG. 2 that, in order to provide the same size of light entrance opening for both sashes, the lower sash profile member 42 has a correspondingly enlarged inner chamber 402 as compared with the chamber 401 of the sash profile member 41.

Figure 3:
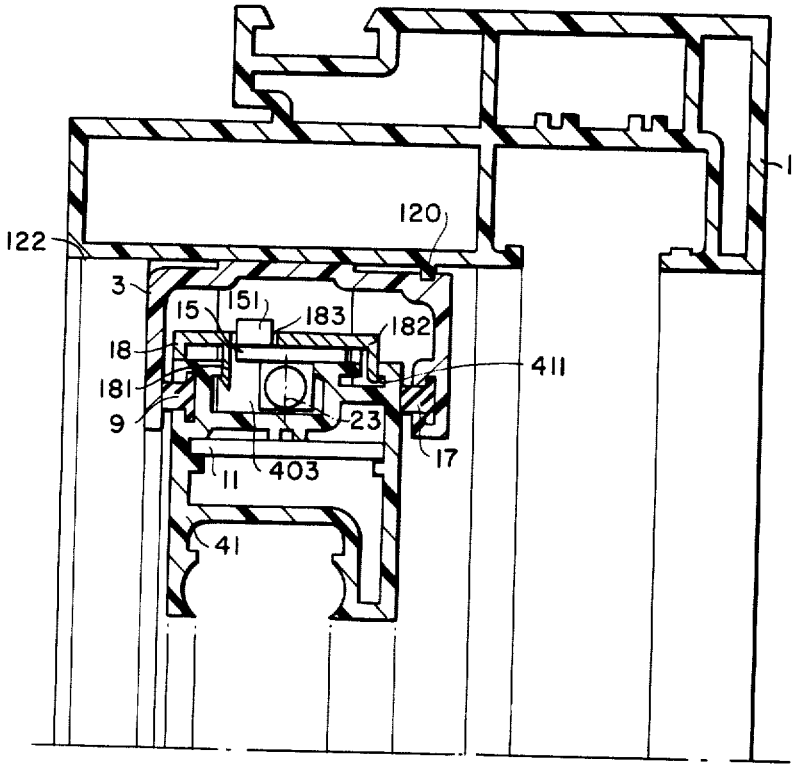
FIG. 3 is a cross-sectional view taken along the line B in FIG. 1.
Figure 4:
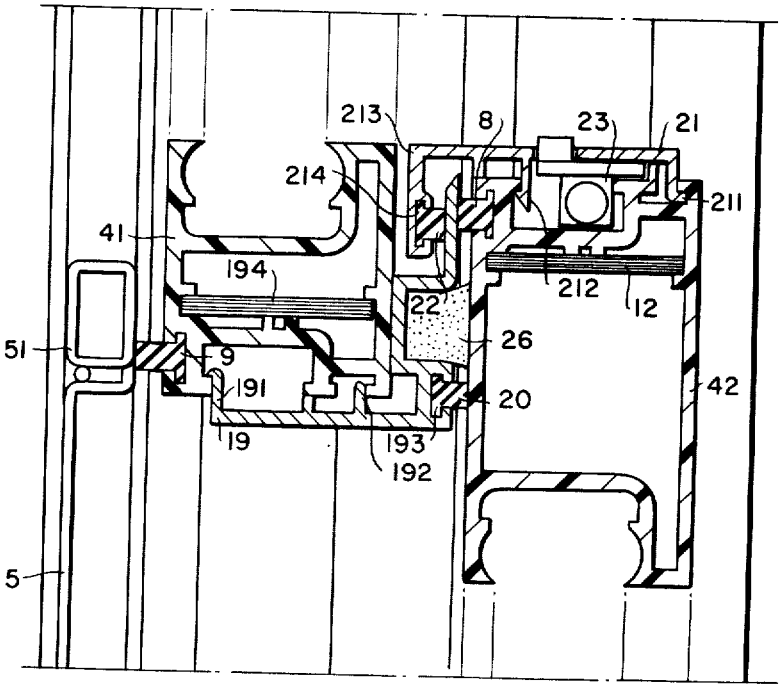
FIG. 4 is a cross-sectional view taken along the line C in FIG. 1.

FIG. 3 provides an example of an abutment of the upper sash profile member 41 against the blind frame profile member 1. In this construction, the U-shaped end profile member 3 is mounted to the blind frame profile member 1 in a region of the planar contact surface 122 by being placed on the guide tongue strip 120 and secured by, for example, gluing or the like. The sash profile member 41 is sealingly inserted in the end profile member 3 due to the sealing means 9, 12 introduced into the corresponding grooves 407, 411 (FIG. 8). A spring fitting 23 is accommodated in the groove 403 which serves to lock the sashes.

For this purpose, the spring fitting 23 is provided with a tongue 15 movable in a direction of the arrow 16 (FIG. 2). The tongue 15 is moved by means of a flap or fishplate 151. The spring fitting 23, accommodated in the groove 403, is adapted to be covered on the outside by means of a profile member 18 which is fashioned as an aluminum profile member.

The profile member 18 is clipped and fixed in position in the corresponding grooves 403, 411 of the sash profile member 41 by means of projecting, hook-shaped extensions 181, 182. The profile member 18 is provided with an opening 183 through which the flap 151 extends. The spring fitting 23 is mounted in each case only on a horizontal top side of a sash, see also FIG. 4, and where the fitting is attached to the upper horizontal side of the lower sash, the fitting 23 is covered by an aluminum profile member 21 of somewhat different configuration.

The aluminum profile member 21 is clipped into grooves 403, 411 of the profile member 42 by means of the hook-shaped projections 211, 212. The profile member 21 also comprises a hook-shaped lug 213 formed with an undercut groove 214 to accommodate a sealing means 22. The lug 213 serves for providing a seal between the two sashes. From the upper sash profile member 41, a profile member 19, provided with a web 194, is clipped onto the sash profile member 41.

The profile member 19 is made of aluminum and projects in a central zone into an interstitial joint so as to provide a corresponding sealing surface. The profile member 19 is also attached to the sash profile member 41 by hook-shaped projections 191, 192 which are adapted to be clipped into the grooves 403, 411. An undercut groove 193 of the sash profile member 41 is oriented toward the second sash profile member 42 and is adapted to receive an additional seal 20 in contact with the other sash profile member 42. Moreover, it is furthermore possible to provide sealing profile members 26 made of, for example, spongerubber or the like.

Figure 5:
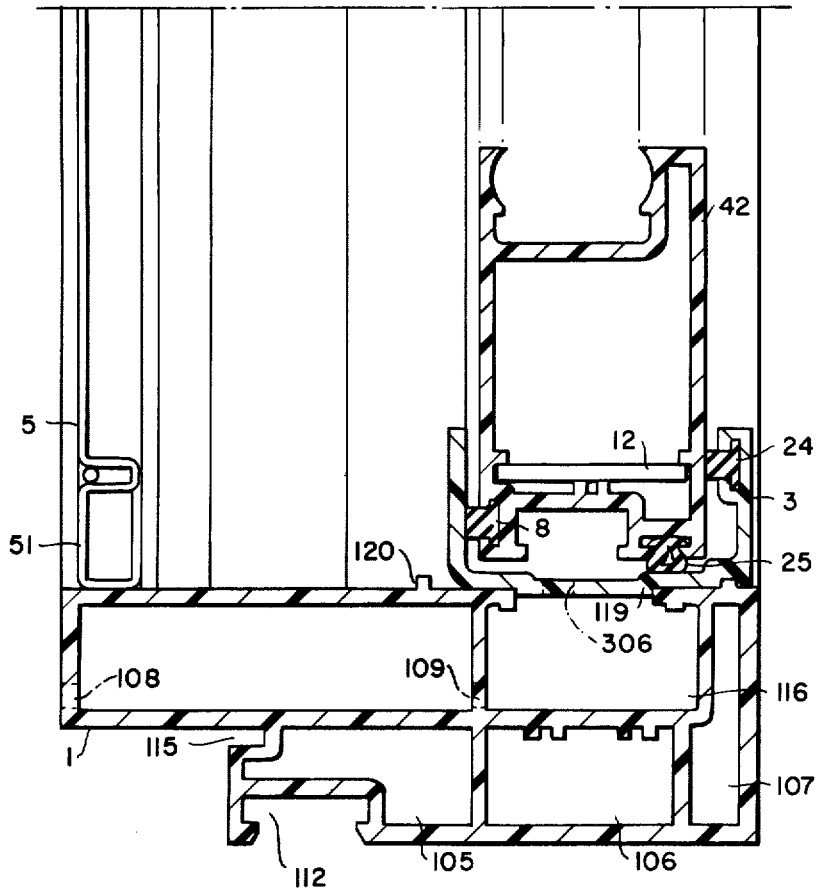
FIG. 5 is a cross-sectional view taken along the line D in FIG. 1.

FIG. 5 illustrates a section through the lower blind frame side of the vertical sliding window of FIG. 1. The sash profile member 42 is guided in the U-shaped end profile member 3 which profile member 3 is inserted in the opening of the guide groove 116 of the blind frame profile 1. By means of inserted sealing means 8, 24, and 25, a desired seal is obtained for the sash. The corner junction of the sash profile member 42 is effected by the corner angles 12 introduced into the corner zone. It is optionally also possible to provide the U-shaped end profile member 3 with drainage openings 306 for establishing a connection to the drainage openings of the blind frame profile member 1.

Figure 12:
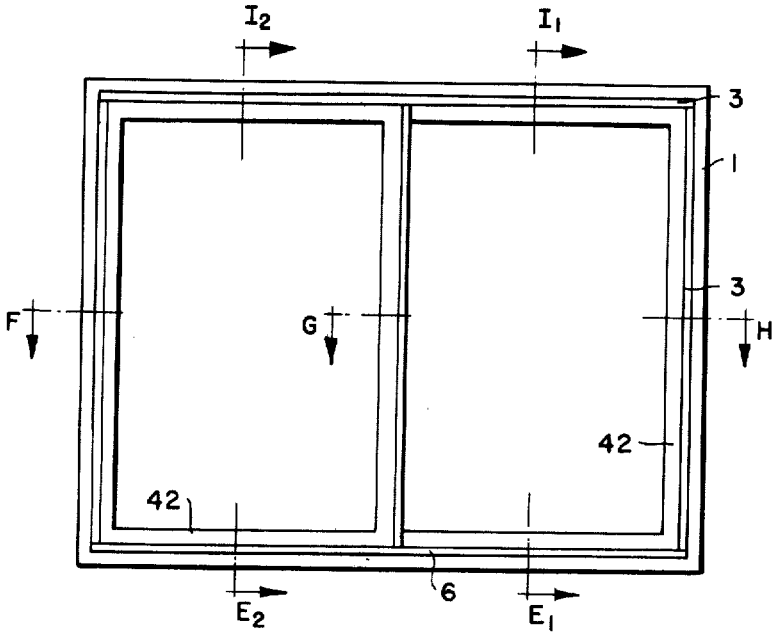
FIG. 12 is an internal view of a horizontal sliding window constructed in accordance with the present invention.

FIG. 12 provides an inside view of a horizontal sliding window made from the window building kit of the present invention. As shown in this Figure, the blind frame is made up of the blind frame profile members 1 with the sashes being made from the sash profile members 2 and with the vertical insides of the upper horizontal inside of the blind frame being respectively connected to one another by two juxtaposed U-shaped end profile members 3. The horizontal lower blind frame side is connected on the inside with a track member 6. As can readily be appreciated, with proper dimensions the horizontal sliding window shown in FIG. 12 may also be utilized as a horizontal sliding door.

Figure 13:
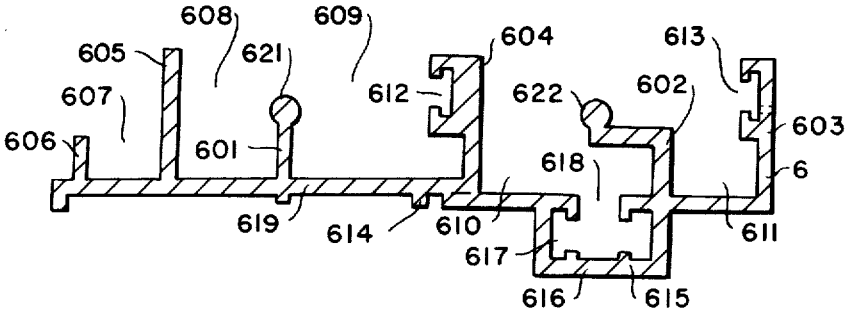
FIG. 13 is a cross-sectional view of a running track in accordance with the present invention.

As shown in FIG. 13, the additional track profile member 6 required for horizontal sliding doors is preferably made up of a metal such as, for example, an extruded aluminum profile. The track profile member 6 corresponds in width to the blind frame profile member 1 and may also project beyond both sides of the blind frame profile member 1. The track profile member 6 is provided at a spacing determined by the sash profile members 42 with running rails 601, 602 cooperable with runners or rollers of the sliding window or door. The running rails 601, 602 branch off from the main web 619 of the track profile member 6. The rails 601, 602 are fashioned with enlarged heads 620, 621 at their ends and the track profile member 6 is further provided with stop lugs 603, 604, 605 at a predetermined spacing from the running rails 601, 602 so that one sash profile member can be guided between the stop lugs 605 and 604 and the second sash profile member can be guided between the stop lugs 604 and 603. The stop lugs 603, 604 are furthermore formed at their ends with undercut grooves 612, 613 for receiving sealing means.

To attach the track profile member 6 onto the blind frame profile member 1, the main web 619 is provided, on a side facing the blind frame profile member 1, with a guide groove 614 corresponding to the guide tongue strip 120 of the blind frame profile member 1 and with a U-shaped shoulder or projection 615 having a width corresponding to the width 119 of the opening of the guide groove 116 of the blind frame profile member 1. The chambers formed between the webs or rails 602, 604, and 605 as well as the chamber 617 formed in the U-shaped projection 615 can be filled with heat insulating materials such as, for example, polyurethane foam. Moreover, by subsequently interrupting the U-shaped shoulder or projection 615 in the zone 616, it is possible to achieve a break in the cold conducting bridge effected by the track profile member 6. A fly screen roller blind can be guided, in turn, in the open groove 607 formed between the webs 605 and 606. The grooves 608, 609 formed between the webs 605, 601 and 604 serve merely for the accommodation and introduction of the sash profile member.

Figure 14:
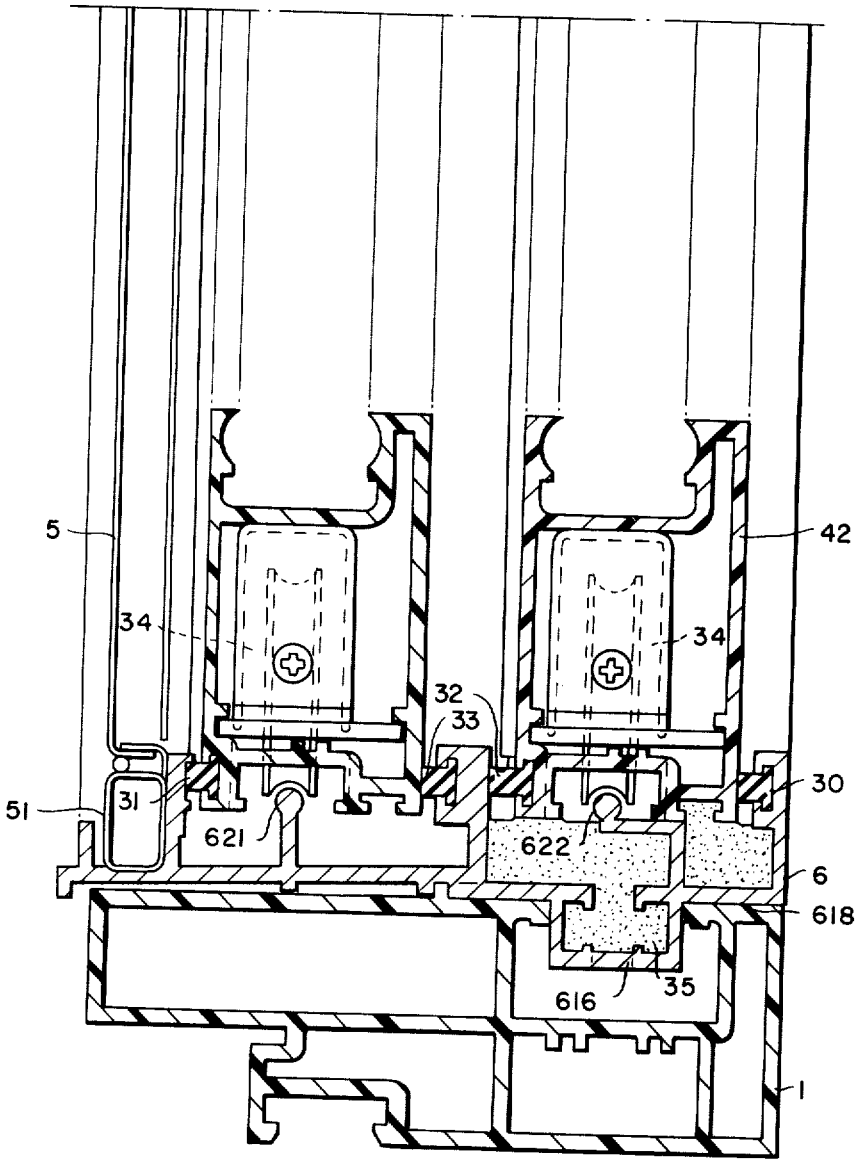
FIG. 14 is a cross-sectional view taken along the lines $E_1$, $E_2$ in FIG. 12.

FIG. 14 provides a cross-sectional view through the lower blind frame of the horizontal sliding window of FIG. 12 wherein the track profile member 6 is seated on the blind frame profile member 1 and is connected thereto by fasteners such as, for example, screws or the like not illustrated in detail and/or by adhesives or glue. At least some of the chambers of the track profile member 6 may be at least partially filled with heat-insulating material 35 and the cold conducting bridge may be interrupted in the zone 618, 616. The runners 34 are mounted in the sash profile members 42 and are seated on the heads 621, 622 of the track profile member 6. Corresponding sealing means 30, 31, 32, 33, are provided in the respective grooves of the sash profile member 42 and in the track profile member 6 for sealing the sashes.

Figure 15:
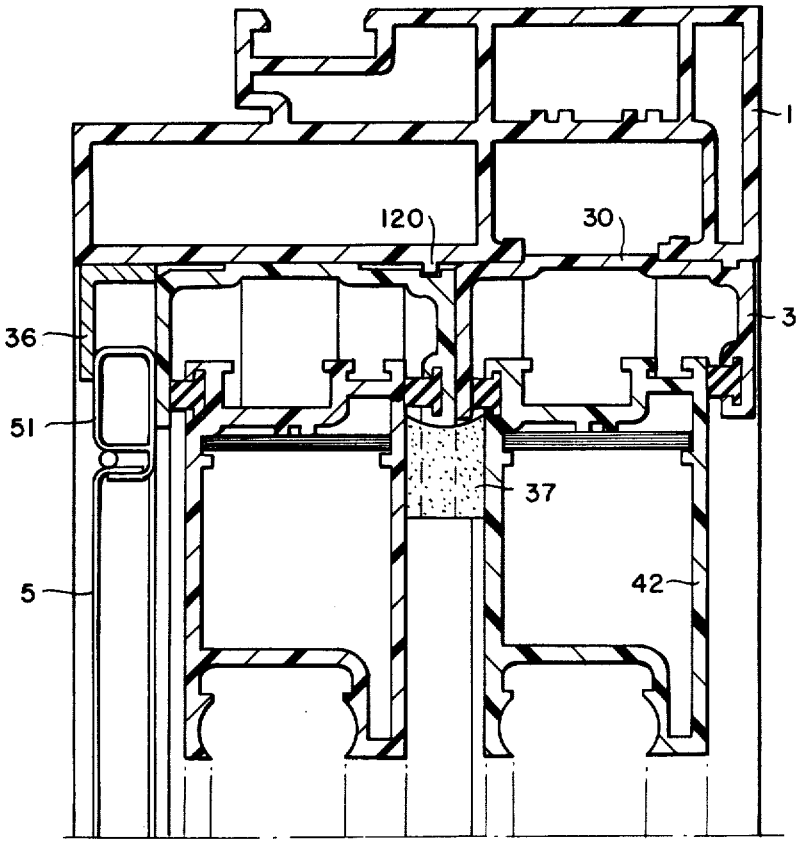
FIG. 15 is a cross-sectional view taken along the lines $I_1$, $I_2$ in FIG. 12.

In FIG. 15, which is a cross-sectional view through an upper blind frame side, the blind frame profile member 1 is provided with two juxtaposed end profile members 3 which are attached by, for example, adhesives, glue, or the like. The sash profile members 42 are guided in the end profile member 3 and, in addition to the seals arranged in the grooves of the sash profile members 42 and of the end profile members 3, a sponge rubber seal 34 can additionally be arranged in, for example, a central area between the sash profile members 42. A guide means 51 for the fly screen roller blind is secured on the outside by an additionally arranged angle profile member 36 attached to the blind frame profile member 1.

Figure 16:
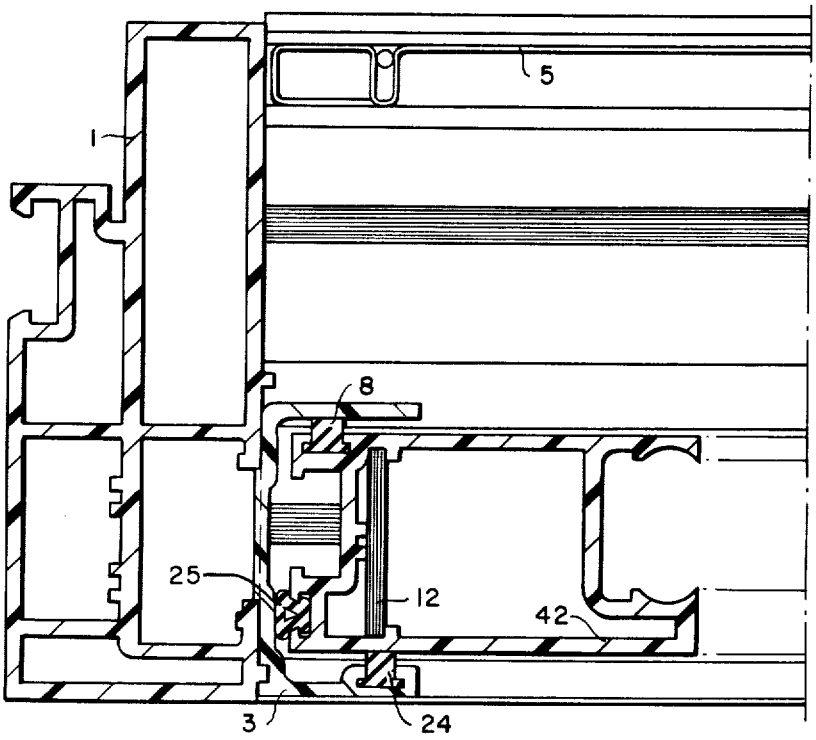
FIG. 16 is a cross-sectional view taken along the line F in FIG. 12.
Figure 17:
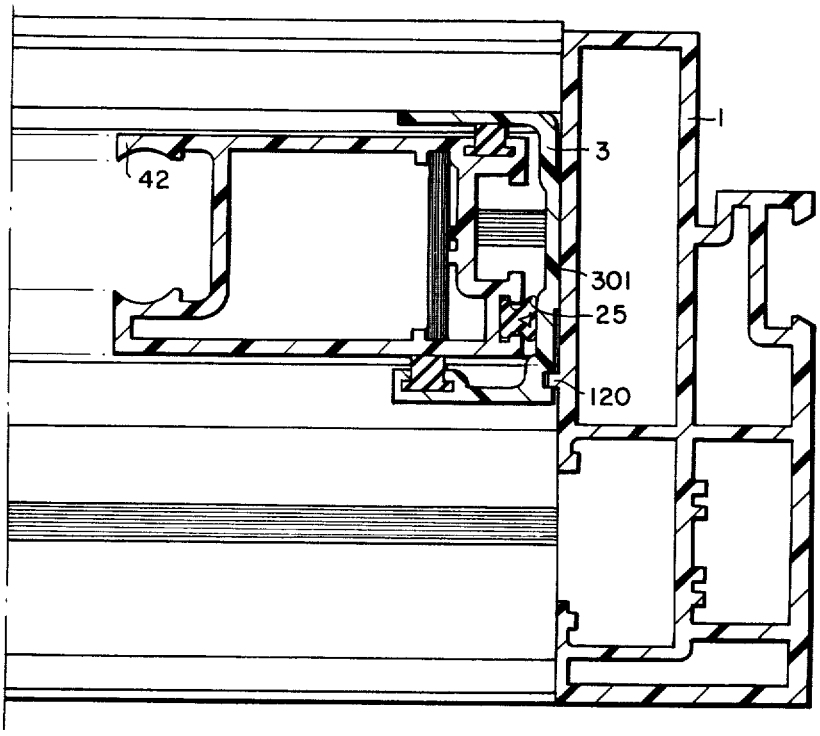
FIG. 17 is a cross-sectional view taken along the line H in FIG. 12.

As shown in the cross-sectional views of FIGS. 16 and 17, taken through the vertical blind frames sides of the horizontal sliding window of FIG. 12, the lateral blind frame profile members 1 are again provided with U-shaped end profile members 3 wherein the sash profile members 42 are sealingly guided. Additional sealing profiles 25 may be provided in the grooves of the sash profile members 42.

Figure 18:
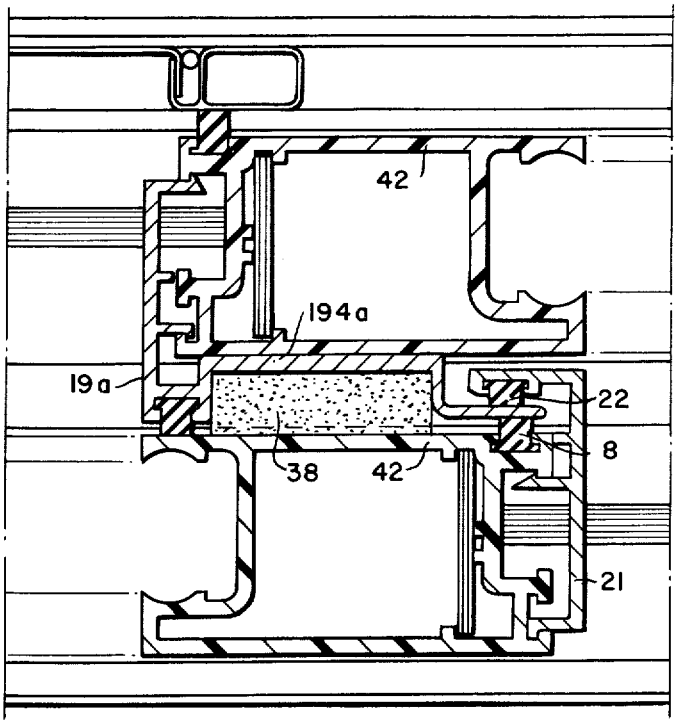
FIG. 18 is a cross-sectional view taken along the line G in FIG. 12.

In FIG. 18, which is a cross-sectional view of the horizontal sliding window of FIG. 12 for the central vertical sash sides, an intermediate seal established by the aluminum cover profile members **21, 19*a*, clipped onto the sash profile members 42 is of particular interest. The aluminum profile member 19*a* differs from the aluminum profile member 19 of FIG. 4 merely in that the web 194 is made of a somewhat greater length in the form of a part or web 19*a*. The end of the web 194*a* engages between the seals 8, 22 of the adjacent sash profile member 42** and thus establishes the desired sealing closure also in the central zone of the sliding window.

While we have shown and described several embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A building kit for vertically or horizontally displaceable windows which include a blind frame means and hollow profile sash means, characterized in that the blind frame means is formed of a blind frame profile member and includes a substantially planar wall on a side thereof adapted to face the sash means, a projecting guide strip means is disposed substantially centrally of the planar wall and extends in a longitudinal direction of the blind frame profile member, an undercut guide groove means opens into the planar wall, chamber means arranged on each side and below said guide groove means, a U-shaped end profile means is adapted to be arranged on the blind frame profile member for sealing an inside of the sash means, and in that means are provided for connecting the end profile means to the blind frame profile member, said connecting means are adapted to enable the end profile means to be selectively guided on one of the projecting guide strip means or in an opening of the guide groove means.

2. A building kit according to claim 1, characterized in that the blind frame means for all four sides of the window have identical construction, and in that sash means for all four sides of the window have identical construction.

3. A building kit according to claim 1, characterized in that the blind frame profile member, the sash means, and the end profile means are formed of a synthetic resinous material.

4. A building kit according to claim 3, characterized in that the synthetic resinous material is PVC.

5. A building kit according to claim 3, characterized in that the end profile means has a width which is at most half of the width of the blind frame profile member.

6. A building kit according to claim 5, characterized in that the connecting means includes an outwardly projecting shoulder means disposed approximately centrally on a web connecting legs of the U-shaped end profile means, and a further guide groove means is disposed in parallel to the shoulder means and is provided in a corner zone of one leg of the U-shaped profile means for accommodating said guide strip means, and in that the shoulder means has a width corresponding to a width of the opening of the guide groove means of the blind frame profile member.

7. A building kit according to claim 5, characterized in that a groove means is provided in one leg of the U-shaped end profile means for accommodating a sealing means.

8. A building kit according to claim 7, characterized in that the sash means includes a sash profile member provided with an open channel means for accommodating a glazing, and in that the open channel means includes lateral walls provided with concave recess means and terminating in projecting lobes.

9. A building kit according to claim 8, characterized in that the sash profile member includes two juxtaposed undercut groove means of differing size on a side opposite the open channel means adapted to selectively attach one of sealing profile or cover profiles for window fittings.

10. A building kit according to claim 9, characterized in that the undercut groove means in the sash profile member are constructed so as to enable the sealing profile or the cover profiles to be clipped therein.

11. A building kit according to claim 9, characterized in that reinforcing means are provided on the blind frame profile member and the sash profile member.

12. A building kit according to claim 11, characterized in that the sash profile member is provided with at least one hollow chamber, and in that the reinforcing means includes reinforcing lobes arranged in the at least one hollow chamber of the sash profile member and in at least one of the chamber means of the blind profile member, and in that the reinforcing lobes are constructed so as to enable an attachment of window fittings.

13. A building kit according to claim 12, for vertical sliding windows, characterized in that a U-shaped end profile means is adapted to be disposed at each blind frame profile member forming horizontal sides of the window, and in that a U-shaped guide profile means is adapted to be arranged at an upper portion of the sash means facing the sash profile member forming vertical sides of the window.

14. A building kit according to claim 13, characterized in that the guide profile means includes at least one pair of hollow chambers, and in that respective legs of the U-shaped guide profile means include respective ones of the pair of hollow chambers.

15. A building kit according to claim 14, characterized in that the U-shaped guide profile means is formed of a synthetic resinous material.

16. A building kit according to claim 14, characterized in that a guide groove is formed between the legs of the U-shaped guide profile means, said last mentioned guide groove having an opening width corresponding to the width of the opening of the guide groove means in the blind frame profile member so as to enable the U-shaped guide profile means to be connected to the blind frame profile member.

17. A building kit according to claim 16, characterized in that one leg of the U-shaped guide profile means terminates in an open groove for accommodating a roller blind of a window screen.

18. A building kit according to claim 17, characterized in that one sash profile member is arranged at an upper portion of the sash means and another sash profile member is arranged at a lower portion of the sash means, at least one hollow chamber of the sash profile member arranged at the upper portion of the sash means has a smaller height than the at least one chamber of the sash profile member arranged at the lower portion of the sash means.

19. A building kit according to one of claims 1 or 12, for horizontal sliding windows, characterized in that the blind frame profile member is adapted to be connected on an upper horizontal side of the window with two juxtaposed end profile means and along respective vertical sides of the windows with an additional end profile means, and in that a metallic running track is adapted to be arranged along a lower horizontal side of the window.

20. A building kit according to claim 19, characterized in that the running track is provided with a U-shaped projecting shoulder on a side thereof adapted to face the blind frame profile member, and in that the U-shaped projecting shoulder has a width corresponding to the width of the opening of the guide groove means of the blind frame profile member so as to enable the running track to be connected to the blind frame profile member.

21. A building kit according to claim 1, characterized in that the connecting means includes an outwardly projecting shoulder means disposed approximately centrally on a web connecting legs of the U-shaped end profile means, and further guide groove means is disposed in parallel to the shoulder means and is provided in a corner zone of one leg of the U-shaped profile means for accommodating said guide strip means, and in that the shoulder means has a width corresponding to a width of the opening of the guide groove means of the blind frame profile member.

22. A building kit according to claim 21, characterized in that a groove means is provided in one leg of the U-shaped end profile means for accommodating a sealing means.

23. A building kit according to claim 1, characterized in that the sash means includes a sash profile member provided with an open channel means for accommodating a glazing, and in that the open channel means includes lateral walls provided with concave recess means and terminating in projecting lobes.

24. A building kit according to claim 23, characterized in that the sash profile member includes two juxtaposed undercut groove means of differing size on a side opposite the open channel means adapted to selectively attach one of sealing profile or cover profiles for window fittings.

25. A building kit according to claim 24, characterized in that the undercut groove means in the sash profile member are constructed so as to enable the sealing profile or the cover profiles to be clipped therein.

26. A building kit according to one of claims 23, 24, or 25, characterized in that reinforcing means are provided on the blind frame profile member and the sash profile member.

27. A building kit according to claim 26, characterized in that the sash profile member is provided with at least one hollow chamber, and in that the reinforcing means includes reinforcing lobes arranged in the at least one hollow chamber of the sash profile member and in at least one of the chamber means of the blind profile member, and in that the reinforcing lobes are constructed so as to enable an attachment of window fittings.

28. A building kit according to claim 1, for vertical sliding windows, characterized in that a U-shaped end profile means is adapted to be disposed at each blind frame profile member forming horizontal sides of the window, and in that a U-shaped guide profile means is adapted to be arranged at an upper portion of the sash means facing the sash profile member forming vertical sides of the window.

29. A building kit according to claim 28, characterized in that the guide profile means includes at least one pair of hollow chambers, and in that respective legs of the U-shaped guide profile means surround respective ones of the pair of hollow chambers.

30. A building kit according to claim 29, characterized in that a guide groove is formed between the legs of the U-shaped guide profile means, said last mentioned guide groove having an opening width corresponding to the width of the opening of the guide groove means in the blind frame profile member so as to enable the U-shaped guide profile means to be connected to the blind frame profile member.

31. A building kit according to claim 30, characterized in that one leg of the U-shaped guide profile means terminates in an open groove for accommodating a roller blind of a window screen.

32. A building kit according to claim 31, characterized in that one sash profile member is arranged at an upper portion of the sash means and another sash profile member is arranged at a lower portion of the sash means, at least one hollow chamber of the sash profile member arranged at the upper portion of the sash means has a smaller height that the at least one chamber of the sash profile member arranged at the lower portion of the sash means.

* * * * *